United States Patent [19]

Fredericks

[11] 4,266,681

[45] May 12, 1981

[54] MULTIPLE BREAKPOINT RESEALABLE AMPOULE

[75] Inventor: Alan D. Fredericks, College Station, Tex.

[73] Assignee: Oceanography International Corporation, College Station, Tex.

[21] Appl. No.: 772,983

[22] Filed: Feb. 28, 1977

[51] Int. Cl.[3] ..... B65D 1/02

[52] U.S. Cl. ..... 215/32

[58] Field of Search ..... 215/32–36; 222/541

[56] References Cited

U.S. PATENT DOCUMENTS

| | | | |
|---|---|---|---|
| 2,517,604 | 8/1950 | Smith | 215/32 |
| 3,063,267 | 11/1962 | Shand | 215/32 X |
| 3,459,185 | 8/1969 | Bender | 215/32 X |
| 3,589,884 | 6/1971 | Guiriec | 215/32 X |
| 3,688,812 | 9/1972 | Fredericks | 141/4 |

*Primary Examiner*—Donald F. Norton

*Attorney, Agent, or Firm*—Richards, Harris & Medlock

[57] ABSTRACT

A multiple breakpoint and sealpoint ampoule capable of being successively broken and resealed.

2 Claims, 4 Drawing Figures

MULTIPLE BREAKPOINT RESEALABLE AMPOULE

BACKGROUND OF THE INVENTION

1. Field of the Invention

The invention relates to glass containers, more particularly to ampoules with multiple breakpoints and sealpoints.

2. Discussion of Prior Art

In analytical chemistry it is often desirable to charge an ampoule with a liquid sample and reagents, then reseal it for subsequent reaction under controlled conditions. Known to the art are single breakpoint, single sealpoint ampoules in which a liquid to be analyzed is introduced into the ampoule with reactants and in which the ampoule is then sealed and placed under reaction conditions as in an oven. After the reaction has occurred, the vial may be broken at the breakpoint to provide access to the reaction product. One such ampoule is disclosed in U.S. Pat. No. 3,688,812, issued Sept. 5, 1972 to Fredericks.

The present invention contemplates the use of a multiple breakpoint and multiple sealpoint ampoule which may also function as a reaction carrier or as a multiple breakpoint resealable container for use in successive operations in which successive breaking and resealing is desirable.

For example, in the analysis of water to determine the chemical oxygen demand, a water sample is placed in an ampoule with reactants such as potassium persulfate and dilute phosphoric acid solution. The vial is then sealed, placed under reaction conditions and ultimately broken at the breakpoint to provide access to the reaction product which may then undergo infrared or spectraphotometric analysis.

The present invention makes it possible to place the reactants in an ampoule at one stage, seal the ampoule and use it as a reagent container, then later admit the sample to be analyzed, resealing it for subjection to reaction conditions, ultimately breaking it to provide access to the reaction product. More generally, the invention is capable of any use in which a series of successive breaking and sealing operations are desired.

SUMMARY OF THE INVENTION

The present invention is an improvement in glass ampoules involving a glass vial having an elongated neck with a plurality of breakpoints and sealpoints located thereon.

DETAILED DESCRIPTION

Figure 1:
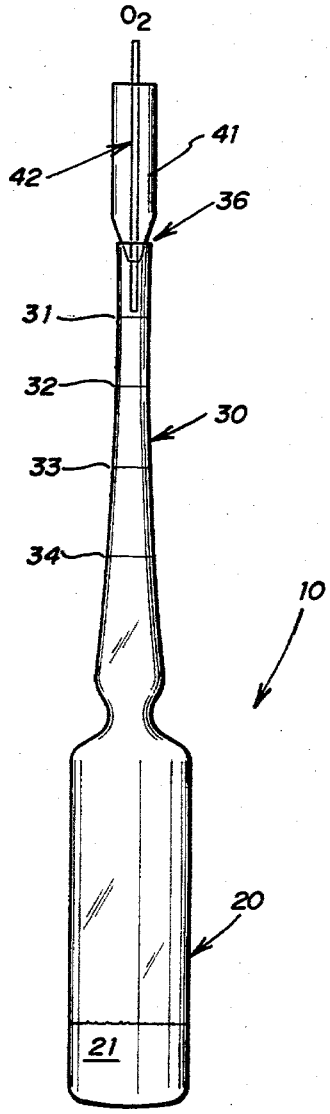
FIG. 1 is an elevational view of an ampoule showing the introduction of a purging apparatus which may be used to seal the ampoule so as to prevent contamination of the reactants.
Figure 2:
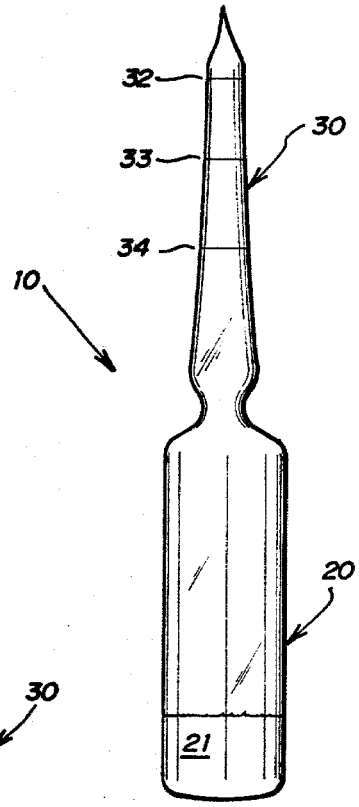
FIG. 2 is an elevational view of the ampoule illustrated in FIG. 1 after the reagents have been introduced and the ampoule sealed.

Referring to FIGS. 1, 2, 3 and 4, ampoule 10 consists of a glass vial 20 with an elongated neck 30. A liquid 21 may be introduced into the vial via neck 30. The vial is capable of being sealed at sealpoints 31 and 33 along neck 30. Neck 30 is sufficiently small in circumference to permit closure when a flame is introduced thereto. The circumference of neck 30 is small relative to the circumference of the vial 20 so that it is relatively easy to close the neck when flame is applied to any of the sealpoints thereon. This makes it possible to seal the ampoule quickly and easily under field or portable laboratory conditions. The first breakpoint 32 is positioned between sealpoints 31 and 33. Breakpoint 34 is positioned below sealpoint 33 in the direction of the vial.

Figure 3:
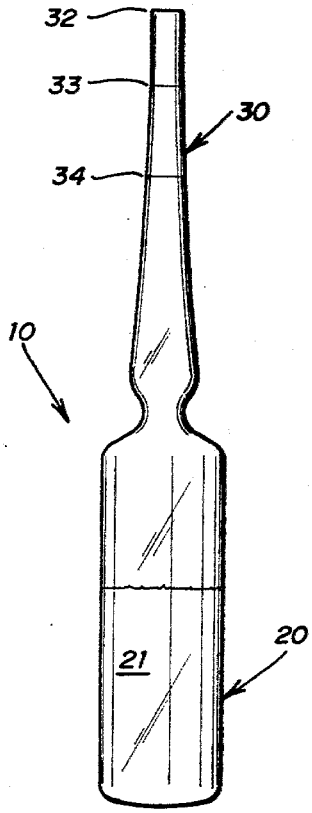
FIG. 3 is an elevational view of the ampoule illustrated in FIGS. 1 and 2 after the first sealpoint has been broken and a sample introduced.
Figure 4:
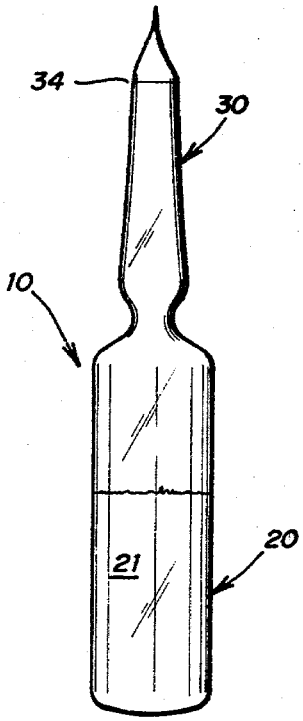
FIG. 4 is an elevational view of the ampoule in FIGS. 1, 2 and 3 after the first sealpoint has been broken, the sample introduced and the ampoule resealed.

In one embodiment of the invention in which the ampoule is to perform a dual function as both a reagent container and reaction carrier, a reagent is introduced into opening 36 of neck 30 as shown in FIG. 1. The ampoule may then be sealed by applying a flame around the neck at sealpoint 31. To prevent contamination, the method for sealing ampoules disclosed in U.S. Pat. No. 3,688,812, issued to Fredericks, may be used. This method involves the circulation of a gas via a conduit 42 and exhaustion thereof through a purge cone 41, shown in FIG. 1, to prevent inflow of contaminants from the flame used to seal the ampoule. The sealed ampoule, shown in FIG. 2, acts as a contamination-free, sealed container for the reactant. When it is desired to introduce the sample into the vial, the neck can be broken at the first breakpoint 32. The breakpoint may consist of any impurity which is diffused by heat into the neck of the vial at desired locations such as at 32 or 34. The impurity may be a mixture of powdered lime-glass or merely a scribe mark around the point at which the glass is to be broken. Any number of such breakpoints may be added to the neck of a vial depending upon the number of times the vial is to be resealed. After the vial has been broken and the sample introduced, as illustrated in FIG. 3, the ampoule may then be resealed by applying a flame to the neck at 33, the second sealpoint. The resealed ampoule will then have the configuration as shown in FIG. 4. The method of sealing ampoules taught by Fredericks in U.S. Pat. No. 3,688,812 may again be used to reseal the container without contamination. The sample with the reactants may then be transported in the sealed container to a reaction environment. After reaction conditions have been applied, access may be had to the reaction product by breaking the ampoule at the second breakpoint 34.

The ampoule with two breakpoints and two sealpoints adapted to serve as both a reagent container and reaction carrier is merely one embodiment of the invention. Also contemplated is an ampoule with more than two breakpoints and sealpoints adapted for any particular use.

Although a particular embodiment of the invention has been illustrated in the drawings and described herein, it will be understood that the invention is not limited to the embodiments disclosed, but is capable of rearrangement, modifications and substitution of parts and elements without departing from the spirit of the invention.

What is claimed is:

1. A reaction carrier and reagent container for use in analytical chemistry capable of being broken and resealed numerous times comprising:

a glass vial having an elongated neeck, said neck being in open communication with said vial and being of relatively small circumference relative to said vial said neck having a plurality of breakpoints and a plurality of heat sealpoints located thereon for successive breaking and sealing of the ampoule.

2. The multiple breakpoint resealable ampoule defined in claim 1 wherein said neck contains two breakpoints and two sealpoints to permit said ampoule to be used as a reagent container and reaction carrier.

* * * * *